US007104733B2

(12) United States Patent
Olafsson

(10) Patent No.: US 7,104,733 B2
(45) Date of Patent: Sep. 12, 2006

(54) AVALANCHE PROTECTION SYSTEM

(76) Inventor: Eggert Olafsson, Jorfa, Kjalarnesi, Reykjavik (IS) IS-116

( * ) Notice: Subject to any disclaimer, the term of this patent is extended or adjusted under 35 U.S.C. 154(b) by 0 days.

(21) Appl. No.: 10/528,028

(22) PCT Filed: Sep. 16, 2003

(86) PCT No.: PCT/IS03/00028

§ 371 (c)(1),
(2), (4) Date: Mar. 16, 2005

(87) PCT Pub. No.: WO2004/025032

PCT Pub. Date: Mar. 25, 2004

(65) Prior Publication Data

US 2005/0286982 A1 Dec. 29, 2005

(30) Foreign Application Priority Data

Sep. 16, 2002 (IS) ..... 6548

(51) Int. Cl.
*E01F 7/04* (2006.01)

(52) U.S. Cl. ..... 405/302.7; 405/302.6; 405/303

(58) Field of Classification Search ..... 405/302.7, 405/302.6; 256/12.5
See application file for complete search history.

(56) References Cited

U.S. PATENT DOCUMENTS 4,335,868 A * 6/1982 Ribbert ..... 256/1
6,382,597 B1 * 5/2002 Mutschler ..... 256/12.5
6,926,471 B1 * 8/2005 Rambaud ..... 405/302.7

FOREIGN PATENT DOCUMENTS

DE 29 36 765 A1 * 4/1981
DE 10164196 A1 * 7/2003
JP 08184014 A * 7/1996
JP 148113 A 6/1999

OTHER PUBLICATIONS

Patent Abstracts of Japan, vol. 1999, No. 11, Sep. 30, 1999 & JP 11 148113 A (Civil: KK; Yoshida Kouzou Design:KK), Jun. 2, 1999.

* cited by examiner

*Primary Examiner*—Frederick L. Lagman
(74) *Attorney, Agent, or Firm*—Venable LLP; Robert Kinberg

(57) ABSTRACT

The invention relates to a method and a protection system for hindering the progress of avalanches that fall with high velocity and contain an enormous amount of energy. The method consists mainly in catching the avalanche in a special Avalanche Protection System (1)—the APS—where the protection system is placed in an oblong storage box (16) on a mountain slope, in a canyon, at the foot of a mountain or at other places, where the risk of falling avalanches exists. The APS can be put up in overlapping rows to form a continuous protective wall against a potential avalanche. The protective device (1) consisting mainly of a semi-circular net sack (9) with mesh and opening; a top rope (13); a foot rope (10); leading strings (12, 14, 15) and wing units (7) attached to the top rope (13) and the net sack (9); main strings (3, 11) which are fastened to ground anchors (2) at one end and at the other end to leading strings (12), foot rope (10) and the top rope (13) of the net sack (9); flat plates (8) that are attached to the main strings (3); storage platform (5) standing on poles (4) which are equipped with locking hinges (6); and a protective helmet (17).

8 Claims, 5 Drawing Sheets

AVALANCHE PROTECTION SYSTEM

TECHNICAL FIELD

Figure 1:
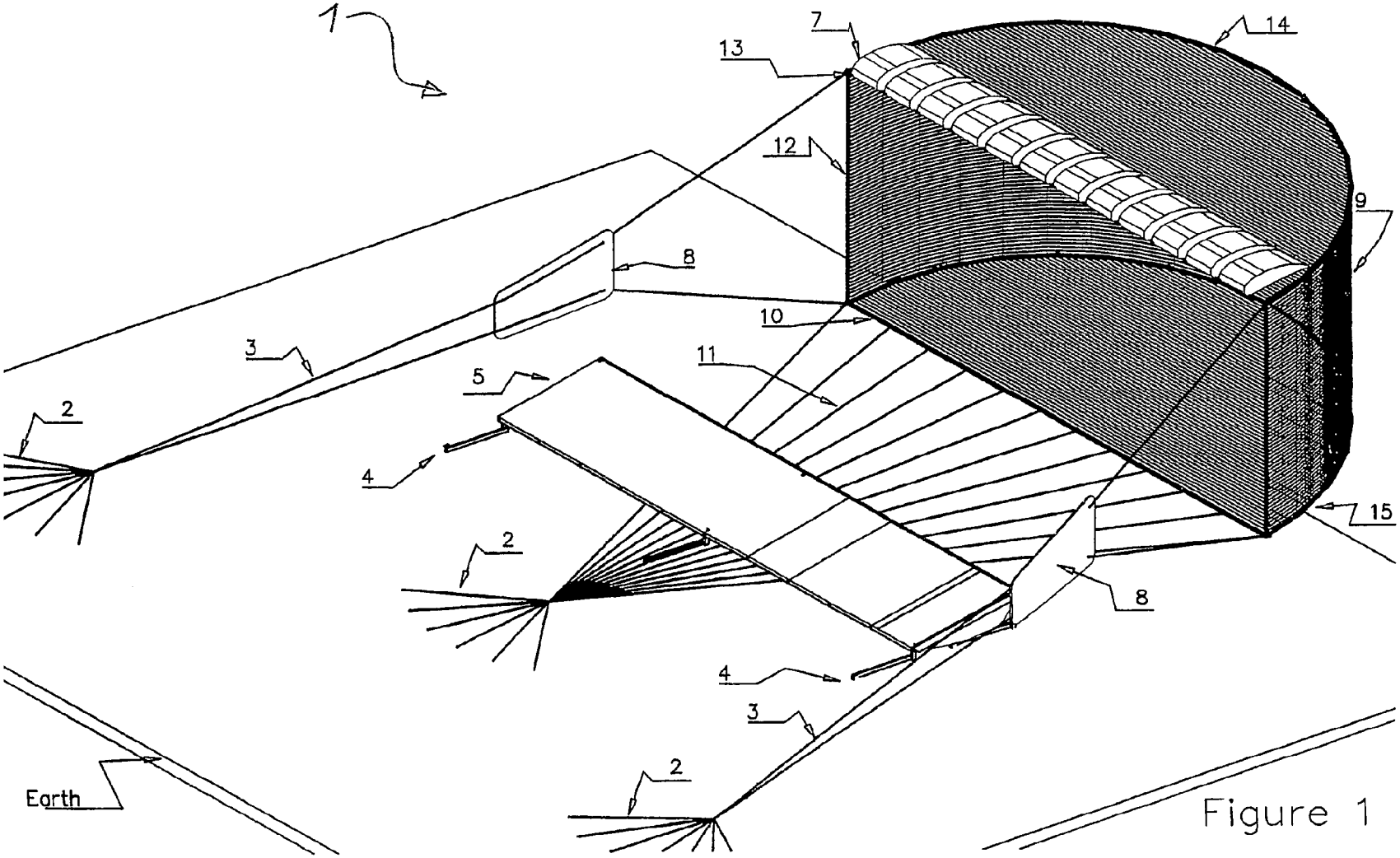

The invention relates to a method and a protection system for hindering the progress of avalanches that fall with high velocity and contain an enormous amount of energy, particularly those heading towards inhabited districts, constructions and other things, that need to be protected.

The method consists mainly in catching the avalanche in the special Avalanche Protection System (APS), where the protection system is planted on a mountain slope, in a canyon, at the foot of a mountain or at other places, where the risk of falling avalanches exists. The APS can be put up in overlapping rows to form a continuous protective wall against a potential avalanche.

BACKGROUND ART

Up until now, many methods of hindering avalanches have been used, but with rather bad results, though. Racks and cones have been raised, ditches and defense walls (embankments) have been built, but these protection systems have not been completely effective: Racks have (been swept away, avalanches have floated over the cones; embankments and ditches require a lot of land and can be dangerous. Embankments are also still at an experimental stage. Estimates show that the first avalanche to fall on a defense wall will almost fill up the slope in front of the wall putting at risk the village or town, that the wall is supposed to protect in the event of a secondary avalanche falling over the first one. In addition, the building of a defense wall or ditches can greatly damage the land, not to mention the view. Building a defense wall is also costly and time-consuming.

DISCLOSURE OF THE INVENTION

The objective of this new invention is to set forth an APS that is simple, safe, successful and, not least, barely visible. It is superior to the other systems in that it does not destroy the view or the land and it can easily be erected high up in the mountains or in canyons where it is difficult to build walls and dig ditches. It is easy to put up, and equally easy to dismantle for inspections, summer storage or maintenance.

This objective is achieved using the method, as disclosed in claim 1, where the method mainly consists in catching the avalanche in a special protection system, which mainly consists of a net sack fastened by main strings to the ground, and an oblong storage box consisting of a storage platform, that stands on poles equipped with hinges, and a protection helmet, where the net sack is ready and waiting inside the storage box, whereas the protection system is planted on a mountain slope, in a canyon, at the foot of a mountain or at other places where the risk of falling avalanches exists, in such a way that one of the long side of the storage box faces the direction from which the avalanche falls and the air mass, that the avalanche thrusts ahead of itself as it falls, flings the protection helmet backwards away from the platform, and where by the net sack opens because of the wing units and the net sack then flings out of the storage box, where the platform and flat plates helps to keep the net sack open because of the effect from the air stream, the form of the wings and the other components and their placement above, below and sideways of the opening of the net sack.

The avalanche is captured in a net sack and the energy of it is converted into heat, which in turn helps to melt some of the snow. The net lets air and snow partly slip through its mesh, but stops the rest of the snow mass by transferring the most part of the energy along main strings and through ground anchors into the earth. During this process the whole APS and the earth warms up, partly by the friction between snow and net and partly by the internal friction of the material of both APS and earth around the ground anchors, when everything stretches out because of the power and pressure from the falling avalanche. At the same time the heat and energy are dissipated, partly by melting the ice crystals, that are forced through the APS, and partly by warming and melting the air and snow around both the APS and earth, which in turn cool down.

The object is also achieved by that the method requires a protection system equipment as disclosed by claim 4: The protection device consisting mainly of a semi-circular net sack with mesh and an opening; a top rope; a foot rope; leading strings and wing units attached to the top rope and the net sack; main strings which are fastened to ground anchors at one end and at the other end to leading strings, foot rope and the top rope of the net sack; flat plates that are attached to the main strings; storage platform standing on poles which are equipped with locking hinges; and a protective helmet.

While existing methods such as ditches and embankments require the intensive and long-term use of heavy machinery, the APS is easy to assemble and erect and does not violate the environment or spoil the view. The only disruptive part of the construction of the APS is when the earth anchors are concreted into the ground. After APS has been installed once, it can be used repeatedly, even though an avalanche falls on the system and perhaps even damages it somehow. In that case, an emergency system can be hooked to the same earth anchors and placed on top of the first system.

Further useful features and advantages of the invention are disclosed in the dependent claims 2–3 and 5–8.

BREIF DESCRIPTION OF DRAWINGS

The invention is described in more detail in the following part with references to the explanatory figures where:

FIG. 1—Shows the entire protection system, set up and ready to halt the avalanche. Shown from the front and above in 3D FIG. 2—Shows the entire protection system. Installed and ready. Shown from behind and above in 3D.

Figure 3:
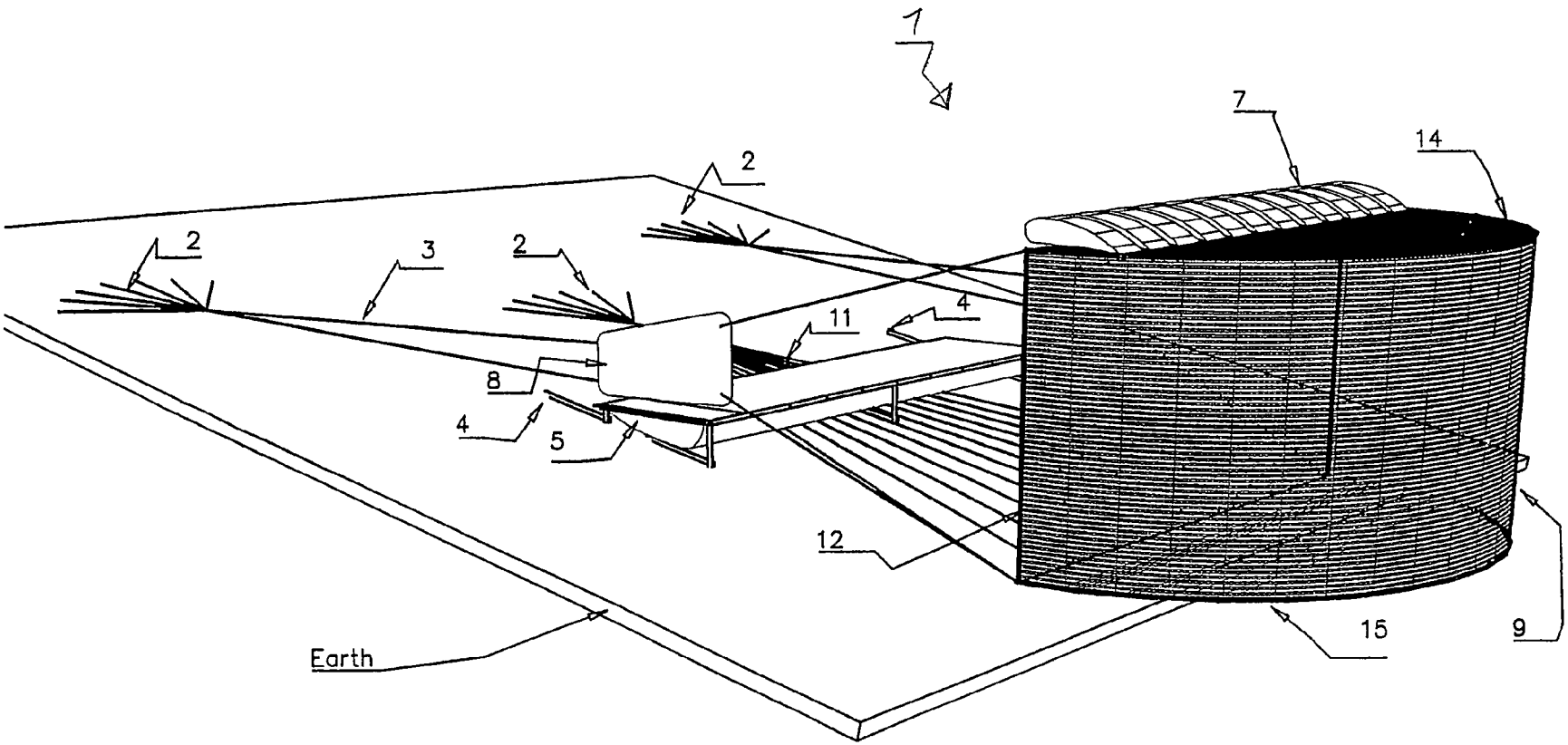

FIG. 3—Shows the entire protection system. Installed and ready. Shown from behind and from a diagonal perspective.

Figure 4:
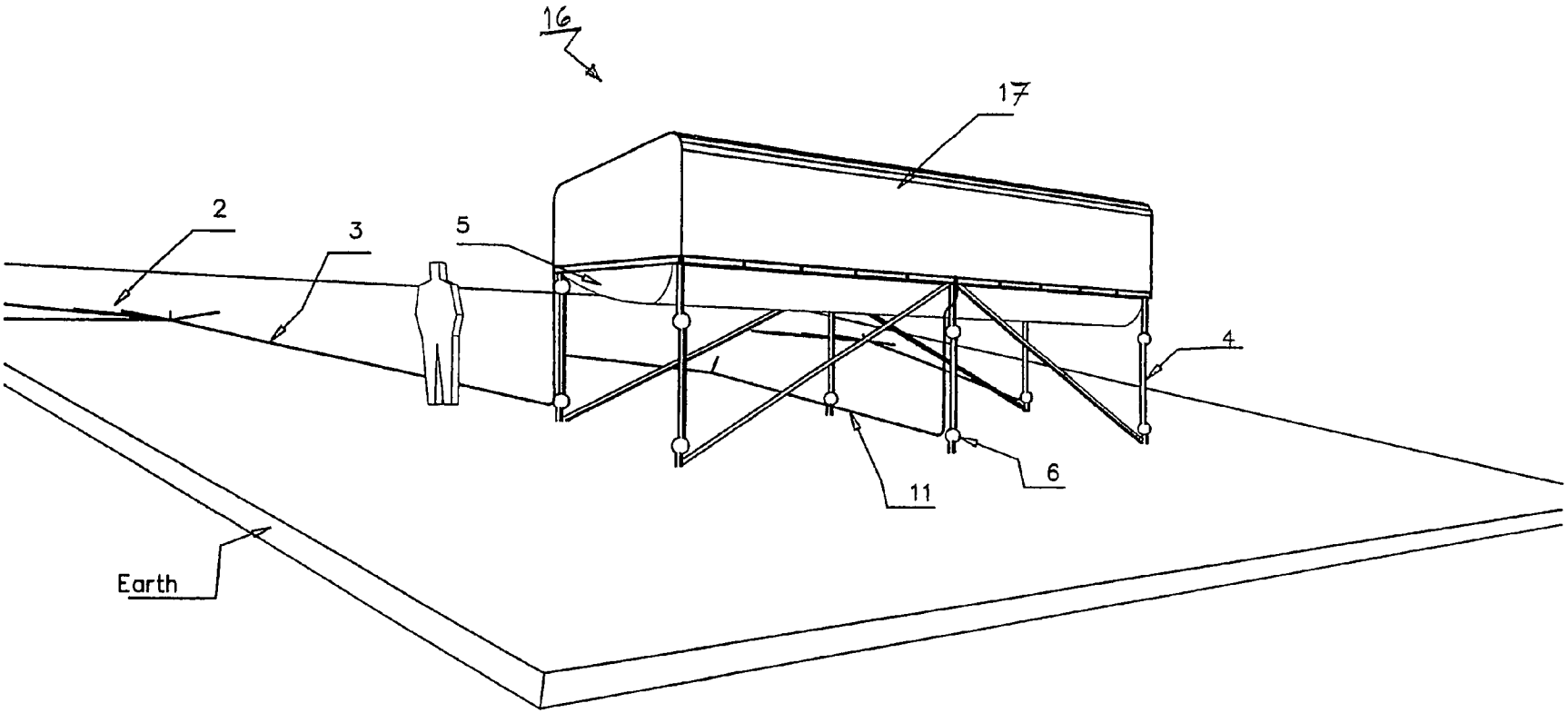

FIG. 4—Shows the APS packed away, ready for use, in its storage box, shown from behind and diagonally in 3D.

Figure 5:
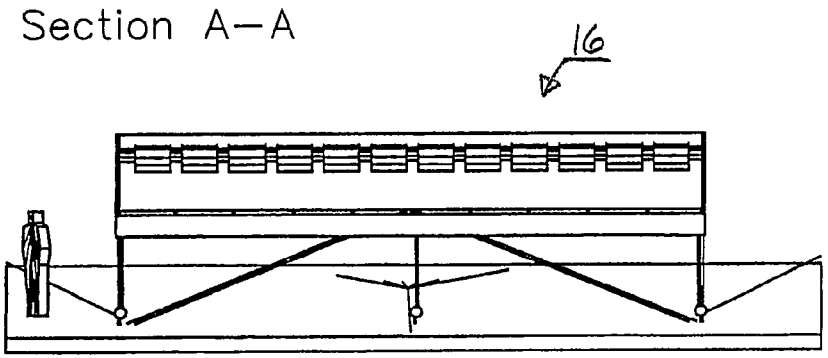

FIG. 5—Shows cross section of the storage box with the APS in it. Cross-section A—A figure nr. 7.

Figure 6:
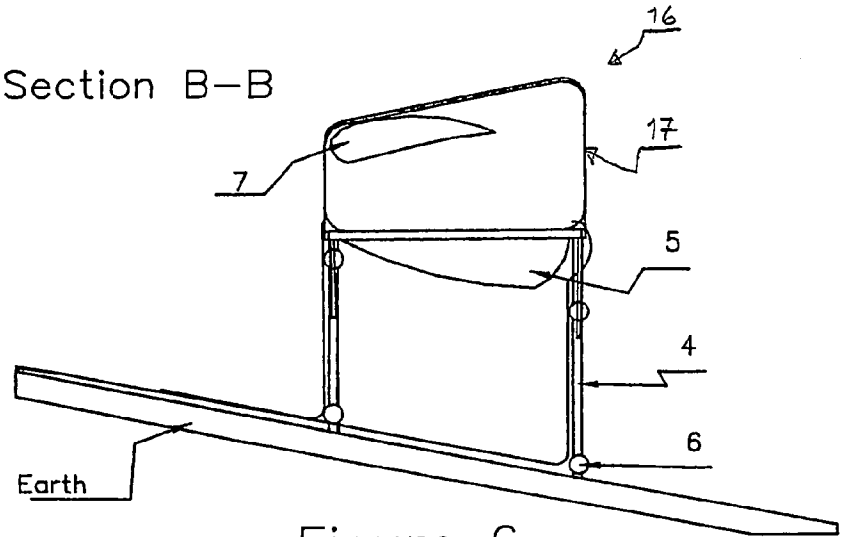

FIG. 6—Shows longitudinal section of the storage box including the APS

Figure 7:
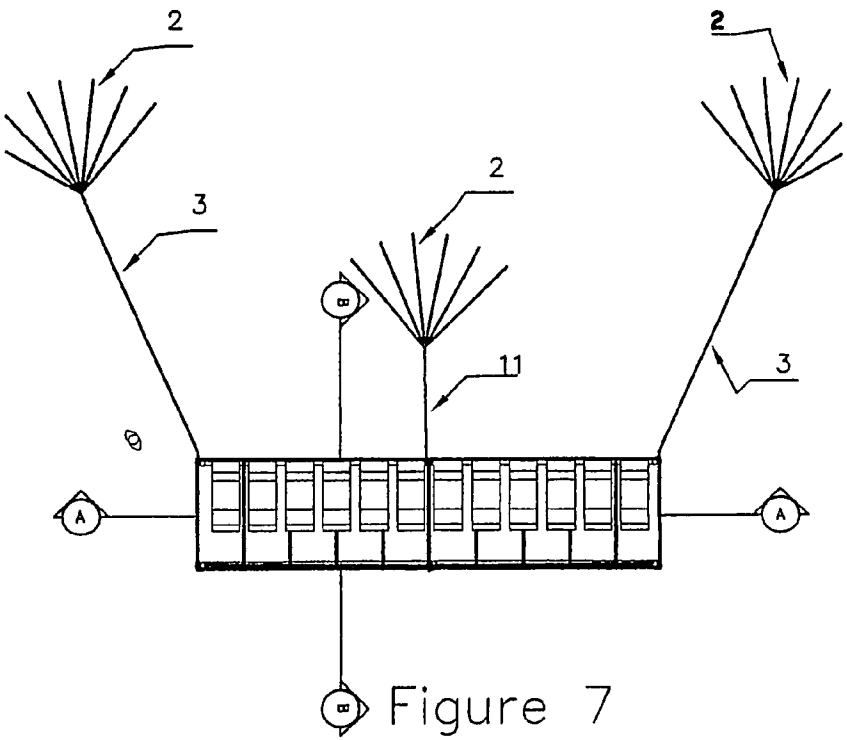

FIG. 7—Shows the APS in its storage box, not in use, from above.

MODES FOR CARRYING OUT THE INVENTION

The APS's technique consists of capturing an avalanche in a special protection system (1) that is stored in an oblong storage box (16), ready to be activated. It can be erected wherever the risk of an avalanche exists. It dissipates the most part of the energy of the avalanche by partly transferring it along main strings (3,11), through the ground anchors (2) into the ground. In addition, by converting rest of the energy to heat the energy is partly disintegrated from the avalanche. The heat develops when the mass of air and snow thrusts into the net sack (9) under a great speed. The ice crystals melt, when they are forced through the net mesh. In this way, the APS stops the avalanche while simultaneously reducing its energy.

The number of APS's (1) units required varies from one to many. They can be set up in overlapping rows to form a continuous protective wall, a second row being placed behind the spaces that inevitably develop in the first row when the units are placed side by side. This increases the effectiveness of the APS and ensures that the avalanche is stopped before it can inflict any damage. The APS units are stored in their storage boxes and are released at the moment that the avalanche begins to cascade towards them, at which point, the net and all the other various parts of the invention are released.

Figure 2:
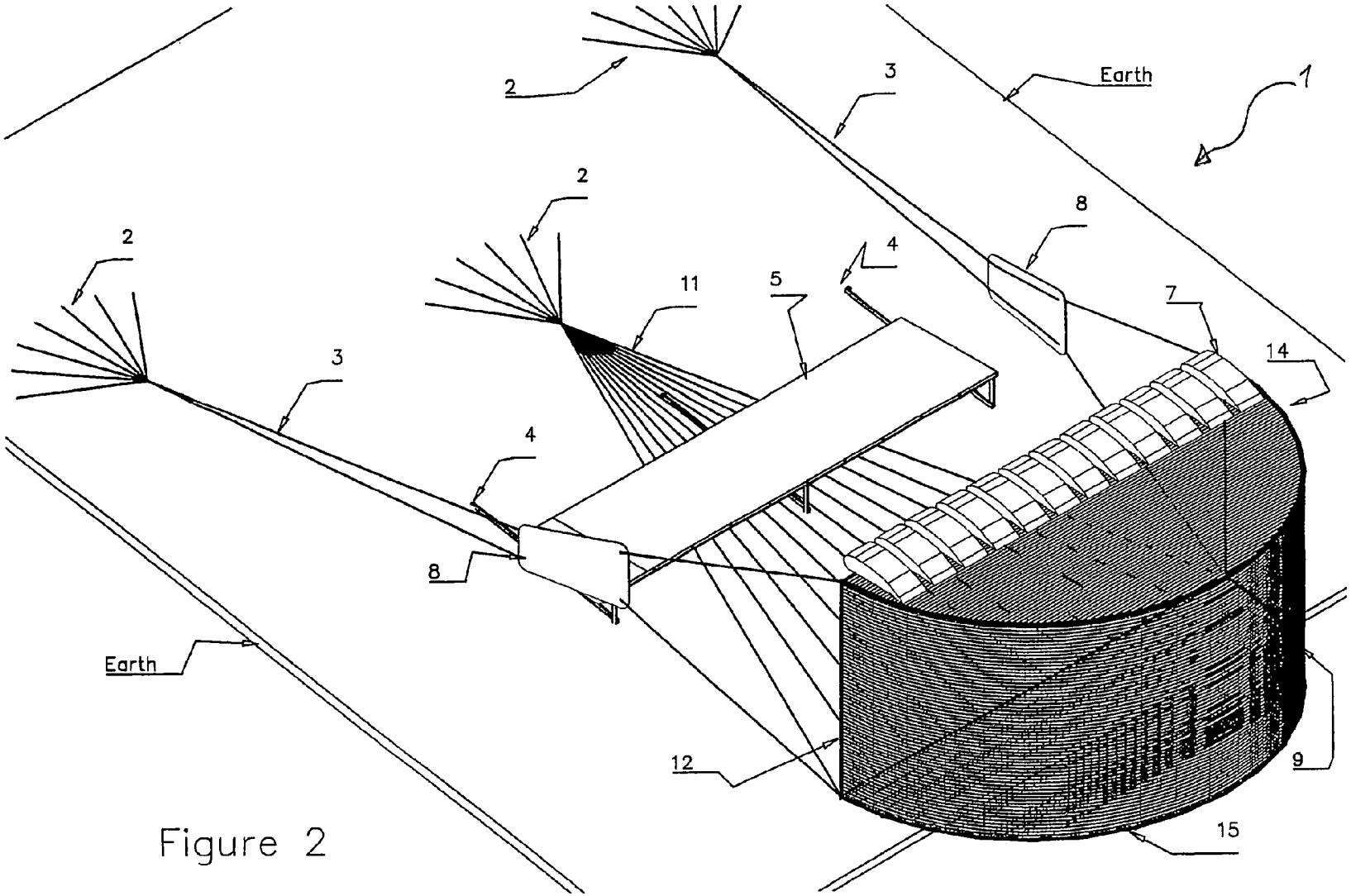

In FIGS. 1–3, the APS's device is shown in its extended position, as if it has just been hit and released by an avalanche. One of the main features of the APS is the semi-circular net sack (9), which has a quadrilateral and almost box-like opening to capture the snow as it crashes down. This opening is formed by strong strings, to which the net sack (9) is fastened, where the strings run along the top, bottom and both sides of the opening and forms the top rope (13), foot rope (10) and the side leading strings (12). The size of the opening is adjustable to cope with the environmental conditions present. The net sack (9) consists of three pieces of net woven together to form the top, bottom, sides and back of the sack. There are two main leading strings (14 and 15), which run from the corners of the front opening around the back of the net giving the sack its shape. The net sack (9) is made from a strong plastic material that is knotted or sawed of plastic straps or woven to form the net mesh of the sack. The through-openings of the mesh can altogether be approximately 30%–90% of the total square area of the net sack—hereafter called the "mesh density". This mesh density can be adapted to suit different situations and locations, either by making the through-openings of the mesh finer or larger, or by using thicker/stronger plastic straps.

Attached to the top rope (13) of the sack (9) and the top of the bag itself is a wing unit (7) that is similar in shape to an airplane wing. This wing unit consists of smaller units that are fastened to each other with pliable attachments in such a way, that the bag's upper edge is slightly flexible and can adjust itself, to some extent, to the flood of snow. When an avalanche falls, it thrusts a great mass of air ahead of it and thereby generates a high velocity wind stroke. As this wind strikes the APS, the APS flings out, the wing unit (7) lifts the top rope (13), whereby ensuring that the net sack (9) opens wide open for the avalanche to fall into. This is essential for the APS to function, as it should.

Another main feature of the APS is the main strings (3, 11) that hold and connect the net sack (9) to some kind of ground anchors (2), which are fastened by concrete in boreholes into the ground. When an avalanche falls into the net sack (9), the main strings (3, 11) transfer some of the avalanche's energy from the net sack over to the ground anchors. The main strings are made of strong steel or fiber, which is an extremely strong material.

Altogether there are four main strings (3), two on each side, which run from the ground anchors (2) to the four corners of the net sack (9), where they meet with the top rope (13) and the side leading strings (12). A flat and oblong plate (8), or a panel, is fastened with one of its longer thin side facing upwards on to each pair of the main strings (3).

The main strings reach from the ground anchors to the flat panels, where they are attached onto the inside edges of the panels, at the top and bottom front corners (see FIGS. 1–3). The main strings run along the panels on the inside and go out through holes at each back corner of the panels and continue to the corners of the net sack (9).

This causes the front end of the panels to splay out slightly when the APS is in a "working position", as shown in FIGS. 1–3. When the APS is hit by an avalanche, the main strings tauten, keeping the sides of the net sack extended and funneling the snow into the bag.

A multiply of main strings (11) connect the foot rope (10) of the net sack (9) to ground anchors (2), which are placed some distance away from the net sack, in front of it and approximately under the longitudinal axis of the APS. These main strings (11) are fastened to the foot rope (10) with even spacing between them, where the number of strings can be adjusted depending on the desired size of the opening. Just before the ground anchors (2), the main strings (11) converge until they meet in one fastening point where they are bound together—then they split again and each and one of them continues to their individual anchors (see FIG. 1). As with the side main strings (3), the main purpose of these lower main strings (11) is to connect the net sack (9) to the ground anchors and to channel the energy from the avalanche to the earth. An additional function of these lower main strings (11), along with the storage platform (5), is to hold the foot rope (10), and thereby the lower edge of the net sack (9), in place and close to the ground, for directing the flood of snow into the net sack.

There are at least three sets of earth fastenings for the APS, each of them consisting of 1–12 separate ground anchors (2). As the main strings approach the ground anchors they converge until they meet in one fastening point where they are bound together. From this fastening point, strong wires run out in a fan pattern, like tentacles, connecting the main strings (3, 11) to the ground anchors, whereby the force of the avalanche is distributed between the anchors. The anchors (2) are steel poles that have been drilled and concreted into the mountain rock. They are made of high strength steel or other strong and durable material.

FIG. 4 shows how the APS (1) looks when installed and packed in the storage box (16). It lies across the expected flow direction of a potential avalanche—ready to catch the first avalanche that falls on it.

The storage box (16) is a collapsible oblong, narrow box. Its main component is a storage platform (5), which forms the base of the storage box. It stands on hinged poles (4) and is covered with a light protective helmet (17) that forms the top of the box. The sides of the box are the flat plates (8), which keep the main strings taut when the APS is released, as previously described. In the storage box, folded and ready for use, rest the net sack (9), the leading strings (10, 12, 13, 14, 15) and as much of the main strings (3, 11) as possible—depending on the distance to the ground anchors (2), as well as the wing units (7), which rest at the top, just under the helmet. The storage box (16) protects the APS from extreme weather conditions such as icing and sunlight. In this manner, the APS should last at least decades if not hundreds of years.

The protective helmet (17) is made of plastic or other light and serviceable material and is loosely fastened to the platform (5), so it can disengage easily when the avalanche smashes on to the storage box (16). This allows the APS (1) to expand unrestrained to capture and stop the avalanche.

The storage platform (5) is oblong and having a flat topside and an aerodynamically curved bottom side;

whereas the shape of the cross-section of the platform is more or less like a wing of an airplane in an upside-down position. It stands on at least six poles (4) that are fastened to the ground rock by concrete. There are diagonal reinforcements or sidebars, between the poles, as shown in FIGS. 4 and 5, to prevent it from standing skew or falling to either side. The poles (4) have at least two hinges (6) each. The hinges are equipped with locking bolts, which make the poles stay erect in the storage position. Not all of the hinges have locking bolts; it depends on the placement of the APS. Under action of a certain force against the poles by an avalanche hitting the storage box (16), the locking bolts snap apart, allowing the poles to hinge and the APS to unfold. This pressure forces the storage platform (5) to fall backwards and down onto the lower main strings (11), whereby holding them securely in place. This in turns holds the foot rope (10) down, ensuring the opening of the lower half of the net sack (9). In this position, the storage platform (5) also works as a spoiler directing the flow of the air and snow into the sack. The poles (4) with hinges (6) and their ground fastenings guarantee that the platform remains in this position while the avalanche rushes over it and into the sack.

The length of the poles (4) vary and is determined by the situation and depth of snow layers in each location, so the storage platform (5) will certainly always be above the deepest snow layers, that have been measured at the location in concern. The poles and platform are made of acid resistant stainless steel, plastic or another strong and durable material that can withstand long-term exposure to the weather and sunlight.

In brief, the APS works as follows: The main part of the APS (1) is folded together, stored but ready for use in a storage box (16), waiting for an avalanche or the cold wind, that an avalanche generates and thrusts ahead of itself, to smash onto the box. Instantly the box collapses: the helmet (17) breaks or flies off the storage platform (5), allowing the APS to open. The power from the strong airflow thrusts the net sack (9) backwards, away from the platform and forces it open, because the wings (7) lift the upper edge of the net sack and the flat plates (8), mounted on the main strings (3), are forced outwards to both sides. The hinges (6) on the poles (4) fold, allowing the storage platform (5), which forms the base of the storage box (16), to fall backwards onto the main strings (11), holding the foot rope (10) and the lower edge of the net sack down, as has been previously described. This guarantees that net sack (9) is wide open and, along with the flat plates (8), funnels the snow into the net sack.

This process builds up a high over pressure in the bag. The temperature then rises, relative to the velocity of the avalanche. The pressure in the sack and in the opening is determined by the density of the net's mesh. A large portion of the avalanche's energy is converted into heat by the snow mass thrusting the compact air and some of the snow out through the net toils, because of the kinetic energy of the avalanche. During this, the ice crystals melt, even before they go through the toils, and change into water drops behind the toils, where there is a low pressure behind the sack, which quickly freezes water drops again. The water drops then change into fuzzy snow crystals that accumulate behind the APS and form a big icy mass. The rest of the avalanche stops in the net sack and piles up.

By this way, the APS dissipates a lot of the energy out of the avalanche. The remaining energy is transferred from the net sack (9) into the leading strings (14, 15) in the sack and from there to the foot rope (10), top rope (13) and the side-leading strings (12), then along the main strings (3, 11) into the ground anchors (2), where it finally transfers into the earth. This occurs while the avalanche is being stopped. The energy converts into heat, i.e. all the equipment involved warms up as well as the cold surroundings, which in turn "eats up" and diffuses the energy during the stopping period of the avalanche.

When one avalanche has been stopped in this way, there is a possibility of erecting an emergency APS onto the already existing ground fastener and thus create a new APS on top of the recently fallen avalanche.

The invention here described is not limited in its use to the aforementioned specification, but can be executed in many ways. For example, the flat plates can be left out and use only the main strings alone between the net sack and the earth fasteners. Furthermore, it can be considered to configure the net sack in different ways. Still further, it is possible to make use of the APS for protecting cities and towns from violent storms.

The invention claimed is:

1. A method to hinder the progress of avalanches that fall with high velocity and contain an enormous amount of energy, characterized by catching the avalanche in a special protection system (1), which mainly consists of a net sack (9) fastened by main strings (3, 11) to the ground, and an oblong storage box (16) consisting of a storage platform (5), that stands on poles (4) equipped with hinges (6), and a protection helmet (17), where the net sack (9) is ready and waiting inside the storage box (16), whereas the protection system (1) is planted on a mountain slope, in a canyon, at the foot of a mountain or at other places where the risk of falling avalanches exists, in such a way that one of the long side of the storage box (16) faces the direction from which the avalanche falls and the air mass, that the avalanche thrusts ahead of itself as it falls, flings the protection helmet (17) backwards away from the platform (5), and whereby the net sack (9) opens because of the wing units (7) and the net sack then flings out of the storage box, where the platform (5) and flat plates (8) helps to keep the net sack open because of the effect from the air stream, the form of the wings and the other components and their placement above, below and sideways of the opening of the net sack.

2. A method according to claim 1, characterized by that the storage platform (5), being oblong and having a flat top side and an aerodynamically curved bottom side and to which the poles (4) are fastened, falls down on to the main strings (11) because of the hinges (6) of the poles (4), when the avalanche smashes on to the protection system (1), where the main strings (11) are fastened to the footrope (10), which is the lower border of the opening of the net sack (9), and thereby the platform (5) holds the net sack down and directs the avalanche into the sack, where, at the same time, the wing units (7), which are fastened to the top rope (13) of the upper border of the opening of the net sack, pulls up the sack's opening because of the air stream, whilst the units (8), which are flat plates fastened, with their thin side up, on to the main strings (3), which are fastened at the one end to each of the lateral sides of the net sack (9) and to the anchors (2) on the other end, secures the opening of the net sack (9) in the lateral direction.

3. A method according to claim 1, characterized by that, at each risk zone for avalanches, a multiple protection system units (1) of variable sizes are installed in overlapping rows to form a continuous protective wall against a potential avalanche.

4. A protection system to hinder avalanches that fall with high velocity and contain an enormous amount of energy, according to the method disclosed in claims 1–3, characterized by the protection device (1) consisting mainly of a semi-circular net sack (9) with mesh and an opening; a top rope (13); a foot rope (10); leading strings (12, 14, 15) and wing units (7) attached to the top rope (13) and the net sack (9); main strings (3, 11) which are fastened to ground anchores (2) at one end and at the other end to leading strings (12), foot rope (10) and the top rope (13) of the net sack (9); flat plates (8) that are attached to the main strings (3); storage platform (5) standing on poles (4) which are equipped with locking hinges (6); and a protective helmet (17).

5. A protection system according to claim 4, characterized by that the net sack (9) is knotted or sawed of plastic straps or woven of plastic material that forms net mesh with 30%–90% density, and the opening of the net sack (9) is quadrilateral and almost box-like in an extended position, with a top rope (13), which forms the upper border of the opening and to which the wing units (7) are fastened; the footrope (10), which forms the lower border of the opening and to which the main strings (11) are fastened; and leading strings (12) that forms the side borders of the opening.

6. A protection system according to claim 4–5, characterized by an oblong storage box (16) consisting of a storage platform (5), which forms the floor of the storage box and stands on at least six poles or feet (4), that have inclined sidebars, whereas the platform (5) is oblong and having a flat top side and an aerodynamically curved bottom side; and further consists of an oblong and box-shaped protection helmet (17) mounted on top of the platform (5), whereas it closes the box that contains the net sack (9), the wing units (7), flat plates (8), and the main strings (3, 11), which are placed on top of the storage platform (5).

7. A protection system according to claim 4–6, characterized by that each pole (4) is equipped with at least two hinges (6) which have lock-bolts that snap apart under action of a force from the avalanche hitting the storage box (16), and the length of the poles (4) is variable.

8. A protection system according to claim 4–6, characterized by the earth fasteners of the protection apparatus (1) are ground anchors (2), which are steel bars that are drilled and fastened by concrete down into the ground forming a semi-circle according to the direction of the force action of the main strings (3, 11), and where each steel bar has an arm that join together to form one fastening point where to the main strings (3, 11) are connected to and there are 1 to 12 steel bars for each fastening point.

* * * * *